United States Patent [19]

Sele

[11] 4,316,788

[45] Feb. 23, 1982

[54] ARRANGEMENT FOR COMPENSATING DETRIMENTAL MAGNETIC INFLUENCE BETWEEN TWO OR MORE ROWS OF LONGITUDINALLY ORIENTED ELECTROLYTIC REDUCTION CELLS, FOR ALUMINUM

[75] Inventor: Thorleif Sele, Snarya, Norway

[73] Assignee: Årdal og Sunndal Verk a.s., Oslo, Norway

[21] Appl. No.: 171,539

[22] Filed: Jul. 23, 1980

[30] Foreign Application Priority Data

Jul. 24, 1979 [NO] Norway ..... 792441

[51] Int. Cl.[3] ..... C25C 3/16

[52] U.S. Cl. ..... 204/243 M; 204/244

[58] Field of Search ..... 204/243 M, 244, 245–247, 204/67

[56] References Cited

U.S. PATENT DOCUMENTS

| | | | |
|---|---|---|---|
| 3,756,938 | 9/1973 | Nebell | 204/243 M |
| 4,090,930 | 5/1978 | Morel et al. | 204/243 M X |
| 4,169,034 | 9/1979 | Morel et al. | 204/243 M X |
| 4,176,037 | 11/1979 | Nebell | 204/243 M |
| 4,210,514 | 7/1980 | Morel et al. | 204/243 M |
| 4,224,127 | 9/1980 | Schmidt-Hatting | 204/243 M |

*Primary Examiner*—Delbert E. Gantz
*Assistant Examiner*—Donald R. Valentine
*Attorney, Agent, or Firm*—Wenderoth, Lind & Ponack

[57] ABSTRACT

Arrangement is disclosed for compensating detrimental magnetic influence on longitudinally oriented pots ($U_3$) in a pot row, from the current in one or more adjacent pot rows, in plants for producing metal, for example aluminum, by electrolytic reduction of a molten bath. Two substantially symmetrical groups ($k_{31}$, $k_{32}$) of cathode taps located at opposite sides of the positive end of the pot, are each connected to a separate compensation bus bar (X, Y) so located in relation to the pot ($U_3$) that they form a current loop around the cathode in a clockwise or in a counter-clockwise direction, depending upon whether a positive or a negative vertical magnetic field is to be compensated for.

7 Claims, 3 Drawing Figures

ARRANGEMENT FOR COMPENSATING DETRIMENTAL MAGNETIC INFLUENCE BETWEEN TWO OR MORE ROWS OF LONGITUDINALLY ORIENTED ELECTROLYTIC REDUCTION CELLS, FOR ALUMINUM

BACKGROUND OF THE INVENTION

In the melt-electrolyctic production it is common to arrange the pots to be electrically connected in series with each other so that there are formed two or more pot rows, and the main current in two adjacent rows of the same series then will have opposite directions. If the pots have their longitudinal axis in the same direction as the row in which they are situated, they are said to be longitudinally oriented. The invention discussed here relates to an arrangement for longitudinally oriented pots in one or more pot rows.

A pot in a pot row will be magnetically influenced by the current in surrounding pot rows, and the influence normally will be a substantially vertically directed magnetic field which is superposed on the magnetic field produced by the current system in the pot itself and the adjacent pots in the same row. The superposed vertical magnetic field is undesired because it generates electromagnetic forces which set up detrimental flow movements in the liquid bath and metal in the pot, and reduce the stability of the pot.

SUMMARY OF THE INVENTION

The object of this invention is to compensate the undesired magnetic field completely or in part by a specific manner of carrying the current through the current bus bars which connect the pots in the row. The arrangement of the invention will be specifically suited to cases where it is desired to change previously uncompensated pots having a symmetrical current bus bar system, into a compensated arrangement, but can also be used in the new construction of pot plants in which the conditions are suitable for such an arrangement.

BRIEF DESCRIPTION OF THE DRAWINGS

This invention will be further described below with reference to the accompanying drawings in which.

DETAILED DESCRIPTION OF THE INVENTION

Figure 1:
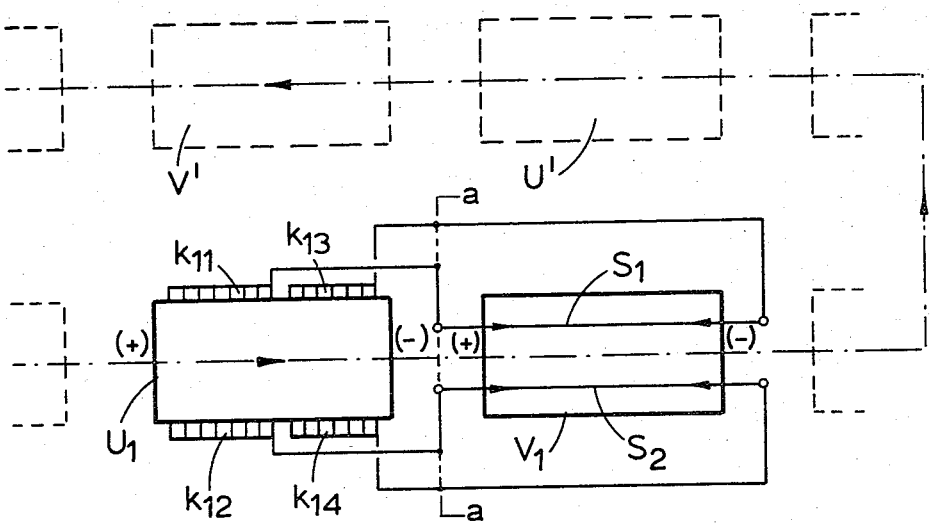
FIG. 1 is a schematic view of a conventional, symmetrical current bus bar system between two electrolytic pots in a row having an adjacent row in which the return current flows in the opposite direction.

In FIG. 1 there is shown a symmetrical current bus bar system which carries the pot current from cathode taps $K_{11}$, $k_{12}$, $k_{13}$ and $k_{14}$ on a pot $U_1$ to anode bus bars $S_1$, $S_2$ on a subsequent pot $V_1$ in a row of pots. In the case of large pots it is common to use so-called two-sided current supply as in FIG. 1, in which the anode is supplied with current both from the positive end and from the negative end of the pot, since this gives more favourable magnetic conditions. The bus bar system may be provided with equipotential connections as indicated with dotted lines at the section a-a, or it may consist of separate branches as shown with full lines. The return current in the adjacent row is indicated at the center-line CL, and pots indicated at U' and V' in the adjacent row in this case will give a positive superposed vertical field in pots $U_1$ and $V_1$.

Figure 2:
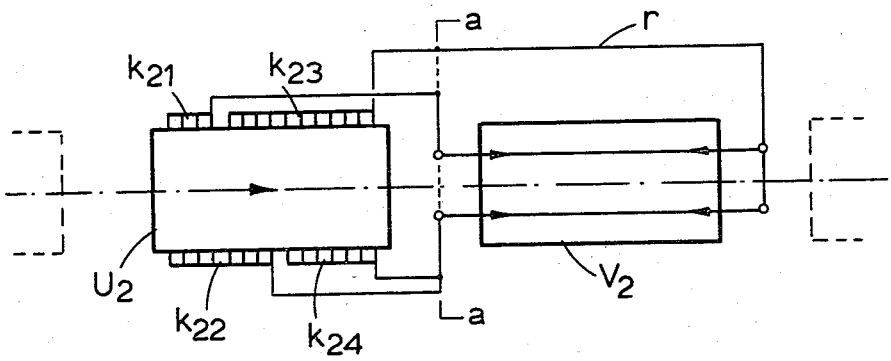
FIG. 2 is a schematic view of a known arrangement of the magnetic field compensation in a situation corresponding to the pot row arrangement in FIG. 1.

There are several ways of compensating for such a magnetic field, for example as shown in Norwegian Pat. No. 122 680, corresponding to U.S. Pat. No. 3,756,938. This known method of compensation is illustrated in present FIG. 2. The compensation in such system is made as an unsymmetric arrangement of those bus bars which distribute the current between the two ends of the anode, in this case the bus bar r which does not have any couterpart at the other side of the pot. In order to obtain a desired current distribution in the bus bar system it is usually necessary to subdivide the cathode taps $k_{21}$, $k_{22}$, $k_{23}$, $k_{24}$ unsymmetrically between the bus bars in this arrangement. Only with the employment of very large equipotential connections as indicated with dotted lines at a—a, a symmetrical arrangement could possibly be used at the cathode taps and that part of the bus bars which lies between the cathode and the equipotential connections. Redesigning an uncompensated bus bar system according to FIG. 1 into a compensated system according to FIG. 2 will normally lead to quite extensive rebuilding, in particular if equipotential connections are not employed.

Figure 3:
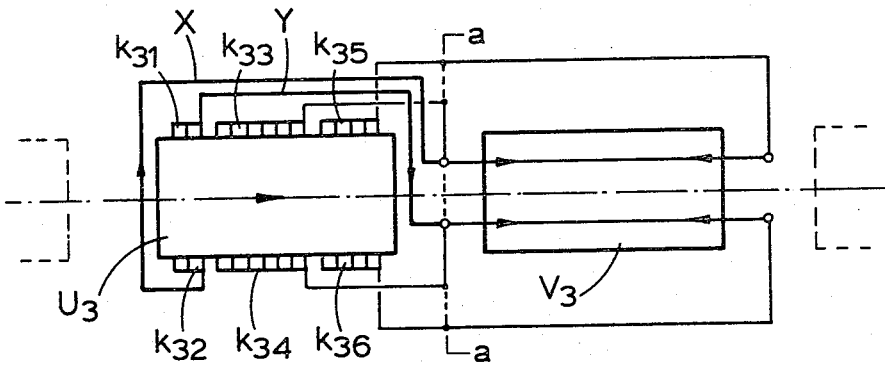
FIG. 3 is a schematic view of an arrangement for magnetic field compensation according to the present invention.

Magnetic field compensation according to the present invention is directed to arranging the compensation in that part of the bus bar system which is closest to the cathode, whereas that part which subdivides the current between the anode ends, remains symmetrical. This is shown in FIG. 3. The substantial part $k_{33}$, $k_{34}$, $k_{35}$, $k_{36}$ of the cathode taps are connected to a symmetrical bus bar system in the same way as with an uncompensated pot. The compensation is obtained in that two smaller groups of cathode taps $k_{31}$ and $k_{32}$ at the positive end of the pot are connected to bus bars X and Y being so located that they result in a current loop around the cathode in a direction clockwise or counter-clockwise depending upon whether a positive or a negative superposed magnetic field shall be compensated for. The compensation bus bars X and Y are carried at a level as high upwardly towards the level of the metal in the pot as practically possible, in order that they shall preferably only have influence on the vertical magnetic field in the pot. The compensation bus bars X and Y are prefereably dimensioned so as to carry equal amounts of current, and they can then be terminated in symmetrical connecting points in the remaining bus bar system, located at suitable positions when the compensation current has passed through the mentioned circulating path around the cathode. The two groups of cathode taps $k_{31}$ and $k_{32}$ are chosen of a size such that the compensation current gives a complete or partial compensation of the undesired magnetic field, in terms of the arithmetic mean value over the anode surface.

It will be obvious from the drawings and the above description that an uncompensated pot according to FIG. 1 can be re-built to the compensated arrangement according to FIG. 3 while retaining substantial portions of the existing bus bar system, and this makes the method particularly attractive for such purposes. Only the compensation bus bars X and Y must be additionally installed, and a moderate change of the cathode connections is carried out.

I claim:

1. An arrangement for compensating, in longitudinally oriented pots of one row of pots of a plant for producing metal such as aluminum by electrolytic reduction of a molten bath, a detrimental vertical magnetic field from current in one or more adjacent rows of longitudinally oriented pots, said arrangement comprising:

first and second substantially symmetrical groups of cathode taps located at opposite sides of the positive end of a pot; and first and second compensation bus bars, connected to said first and second groups of cathode taps, respectively, said first and second compensation bus bars being located in relation to the pot so as to form a current loop around the cathode of the pot in a clockwise direction or in a counter-clockwise direction, depending on whether the detrimental vertical magnetic field to be compensated is positive or negative.

2. an arrangement as claimed in claim 1, wherein said first and second compensation bus bars are dimensioned to carry equal amounts of current.

3. An arrangement as claimed in claim 2, wherein said first and second compensation bus bars are connected symmetrically to the bus bar system of the pot and the next downstream pot of the row.

4. In a plant for producing metal such as aluminum by electrolytic reduction, said plant having plural rows of longitudinally connected pots, each said pot including an anode having a positive upstream end and a negative downstream end and plural groups of cathode taps on positioned on opposite sides of said anode from said upstream end thereof to said downstream end thereof, and a primary bus bar system for carrying current from said cathode taps to the anode of the next downstream pot, the improvement of means for compensating a detrimental vertical magnetic field from one said row of pots in a said pot of an adjacent said row of pots, said compensating means comprising:

said groups of cathode taps including first and second substantially symmetrical groups of cathode taps located at said opposite sides of said anode adjacent said positive upstream end thereof, said first and second groups of cathode taps not being directly connected to said primary bus bar system;

first and second compensation bus bars, connected to said first and second groups of cathode taps, respectively, said first and second compensation bus bars being located in relation to said pot so as to form a current loop around said cathode of said pot in a clockwise direction or in a counter-clockwise direction, depending on whether the detrimental vertical magnetic field to be compensated is positive or negative.

5. The improvement claimed in claim 4, wherein said first and second compensation bus bars are dimensioned to carry equal amounts of current.

6. The improvement claimed in claim 5, wherein said first and second compensation bus bars are connected symmetrically to said primary bus bar system.

7. The improvement claimed in claim 6, wherein said primary bus bar system is connected symmetrically to said anode of said next downstream pot.

* * * * *